US005530215A

United States Patent [19]

Couvreur

[11] Patent Number: 5,530,215

[45] Date of Patent: Jun. 25, 1996

[54] PRESSURE SWITCH

[75] Inventor: Jean F. Couvreur, Naperville, Ill.

[73] Assignee: Furnas Electric Company, Batavia, Ill.

[21] Appl. No.: 147,886

[22] Filed: Nov. 5, 1993

[51] Int. Cl.[6] ..... H01H 35/34

[52] U.S. Cl. ..... 200/83 R; 200/83 J; 200/83 Q; 200/83 W; 200/83 Z; 200/293

[58] Field of Search ..... 200/81 R, 82 R, 200/83 R, 83 J, 83 P, 83 Q, 83 S, 83 W, 83 Z, 293

[56] References Cited

U.S. PATENT DOCUMENTS

| | | | |
|---|---|---|---|
| 3,283,111 | 11/1966 | Wirsching | 200/168 |
| 3,764,763 | 10/1973 | Barnes | 200/835 A |
| 3,875,358 | 4/1975 | Willcox | 200/83 P |
| 4,166,996 | 9/1979 | Matthies | 337/386 |
| 4,863,356 | 9/1989 | Lindsey et al. | 200/83 P |
| 5,139,051 | 8/1992 | Walstad et al. | 137/630 |
| 5,338,908 | 8/1994 | Rahman et al. | 200/83 P |

*Primary Examiner*—Kristine L. Kincaid
*Assistant Examiner*—Michael A. Friedhofer
*Attorney, Agent, or Firm*—Wood, Phillips, VanSanten, Clark & Mortimer

[57] ABSTRACT

The problem of providing plurality of different models of pressure switches to suit the requirements of a plurality of differing manufacturers may be minimized or eliminated in a pressure switch, including a frame (20), a diaphragm (50) secured to the frame (20) and adapted to be exposed to a mechanical source of fluid under pressure, such as a compressor, and electrical contacts (64), (66), (70) mounted on the frame (20) for relative movement toward and away from each other between open and closed positions. A lever system (72), (80) is mechanically interposed between the diaphragm (50) and the contacts (64), (66), (70) for effecting the previously mentioned relative movement and an unloader valve (110) is mounted on the frame (20) and adapted to be connected to the source of pressure fluid and operable when the contacts (64), (66), (70) are in an open position to vent fluid under pressure from the source. The system includes a bell crank (118) responsive to the lever system (72), (80) for operating the unloader valve (110) and the frame (20) is provided with at least two spaced mounting elements (116), (164), (166), (168) for mounting the unloader valve (110) with the bell crank (118) being selectively mountable at points (126), (127) adjacent either of the mounting elements (116), (164), (166) and (168).

19 Claims, 6 Drawing Sheets

FIG. 3
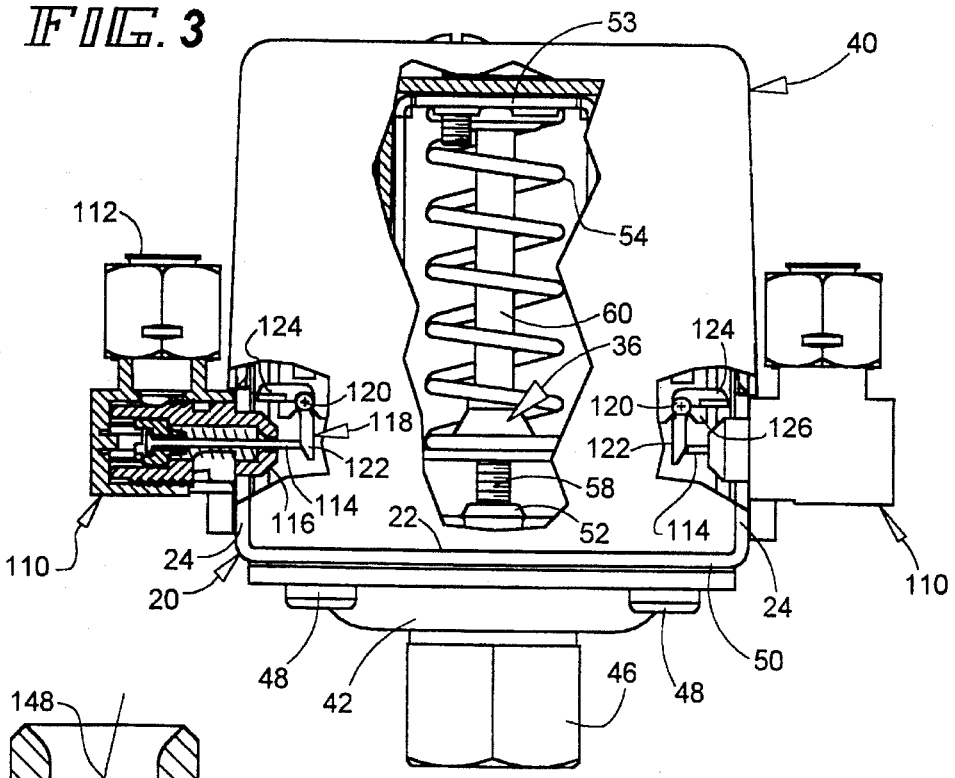
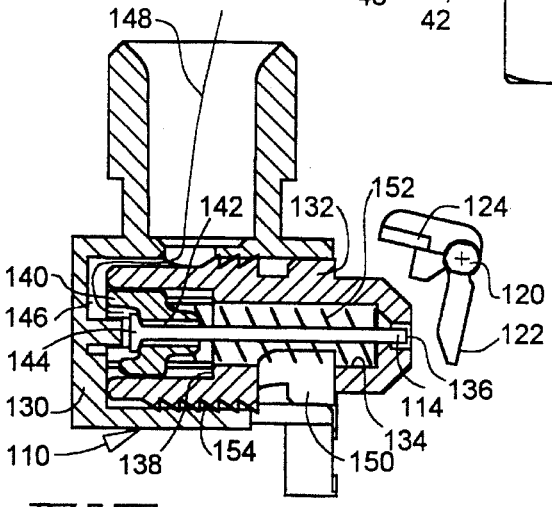
FIG. 4
FIG. 5
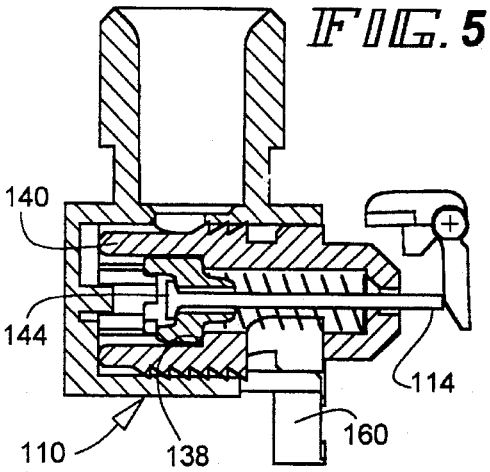
FIG. 6
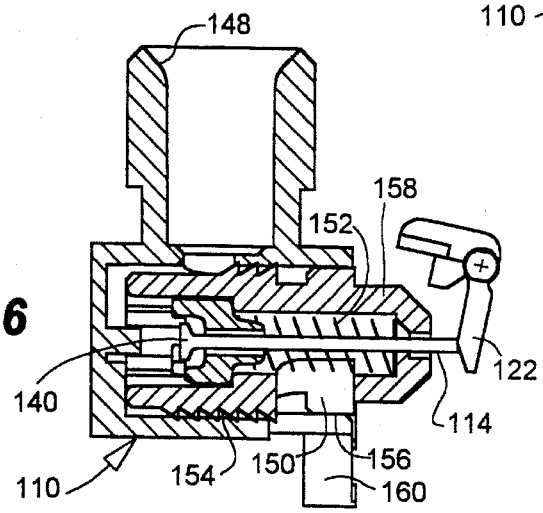
FIG. 7
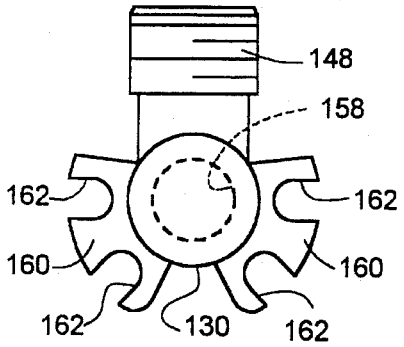

PRESSURE SWITCH

FIELD OF THE INVENTION

This inventions relates to electrical switches, and more specifically, to pressure switches that are adapted to be connected to a source of fluid under pressure, the pressure of which determines the condition of the switch.

BACKGROUND OF INVENTION

Pressure switches have been used in a large variety of applications where the pressure of a fluid is used to alter the condition of an electrical circuit. Once particularly familiar application is in connection with air compressors. In such a case, a positive displacement machine is frequently driven by an electrical motor. The positive displacement machine draws air from the ambient and compresses it to a higher pressure. The compressed air is then discharged into a reservoir for storage for subsequent use.

As is well known, the reservoir will typically have pressure limitations. That is to say, if the internal pressure of the fluid stored within the reservoir exceeds some predetermined value, there is the possibility that the reservoir may rupture.

To prevent such from happening, the compressor system is typically provided with a pressure switch. When the pressure in the reservoir reaches some predetermined value, the pressure switch opens to open the circuit for the electrical motor driving the positive displacement machine. This, in turn, means that the compression part of the operating cycle will terminate and there will be no further increase in pressure within the reservoir as no further air is being delivered thereto by the now inoperative compressor.

As the pressurized fluid within the reservoir is utilized, the pressure in the reservoir will drop. At some predetermined pressure, typically somewhat below the shut off value mentioned previously, the pressure switch will close to again energize the electrical motor for the positive displacement machine. This, in turn, will cause the reservoir to be refilled until the first predetermined pressure is again reached, at which time the pressure switch will open to stop further operation of the electrical motor.

Similar systems are employed with fluids other than gaseous fluids as, for example, in water pumping systems. For example, in a typical home water system supplied by well water, a submersible pump is operative to elevate water to a sealed reservoir or tank. Because the tank is sealed, as it fills, the pressure of air above the water in the tank increases. This pressure head is used to drive water from the tank into the distribution system within the home when faucets or valves are opened. Check valves are utilized to prevent such pressure from driving the water back into the well.

Quite typically, the pressure within the reservoir is taken as a measure of the degree of filling thereof. Most usually, pressure is monitored at a tank outlet which will be below the level of water in the reservoir by means of a water pressure sensing switch, which in turn is operative to initiate operation of the pump when the pressure is low and to halt operation of the pump when the pressure is raised to a level indicating that the reservoir has been sufficiently filled.

Returning the matter of air compressing systems, those skilled in the art will readily appreciate that when the positive displacement machine is shut down by the pressure switch, there will be a relatively high residual pressure in the conduit leading from the positive displacement machine to the reservoir, as well as in the positive displacement machine itself. In order to restart the air compressor, it is necessary that the same be powered sufficiently so as to overcome the resistance provided by the residual high pressure. This frequently would require an overly large motor solely for starting purposes where a much smaller motor would be capable of driving the machine after it has been started. This in turn can mean higher levels of energy consumption, as well as a higher initial capital cost because the need for an overly large motor.

To avoid this, it has been conventional in the air compressor industry to provide a so called "unloader" valve. An unloader valve is operative, upon cessation of operation of the positive displacement machine, to vent the machine, but not the reservoir, to the atmosphere so that internal pressure within the machine is atmospheric pressure as opposed to the much higher pressure in the reservoir. Thus, when the machine is restarted, it need only overcome the resistance of friction, allowing the use of a relatively small motor. In the usual case, pressure switches are configured so that as they revert from a closed or electrically making position to an open or electrically breaking position, they also operate the unloader valve.

One difficulty faced by the manufacturer of pressure switches is the fact that not all of its customers will have the same configuration of compressor system components. That in turn means that some customers may wish the compressor connection port on the unloader valve to be opening upwardly, some to the right side, some to the left side, etc. To manufacture a wholly different pressure switch for each such situation is obviously undesirable because of the increased costs involved in making three different switches, for example, rather than one.

Pressure switches also customarily include a manual override with a manual operator which can be manipulated by the user to initiate operation of the motor being controlled by the switch or to halt its operation. Typically, these operators are in the form of a lever which protrudes from one side of the switch. Again, depending upon the configuration of system components, one system manufacturer may want the manual operator to protrude from one side of the switch while another system manufacturer will want the operator to protrude from another side of the switch. Again, two different switch configurations are called for and to manufacture two separate switches for the purpose would again be unduly expensive and inefficient.

Still, another problem that is commonly encountered in the operation of systems of this type may be chattering of the electrical contacts relative to one another when in the electrical making or closed position. Chattering causes premature wear and can cause pitting and even arcing difficulties in severe situations. In the usual case, chattering results from vibration imparted to the pressure switch during operation of the positive displacement machine which frequently includes a piston. Not infrequently, the plane of closure of the contacts will be either parallel to the base of the switch, or at right angles with respect thereto. The switch itself will be mounted in a system such that its base will be parallel to or at right angle to the direction of reciprocation of the piston in the positive displacement machine. In such a situation, contact chatter is at its worst.

Those skilled in the art will also recognize that pressure switches typically have a differential mechanism which has the effect of setting the pressure at which the switch contacts will open over that at which they will close. Typically, this mechanism is utilized to set the differential between the pressure at which the compressor is turned off and the second and lower pressure whereat it will again be turned on to replenish the reservoir. As this mechanism sets the pressure level based on the highest pressure encountered in the cycle, adjustment of it may result in a change in the pressure at which cut out occurs. More desirably, the differential should be adjusted based on the so called "cut in pressure" whereas operation of the positive displacement machine is resumed in response to partial depletion of the reservoir. In this way, a desired differential can be achieved without altering, in any way, the high pressure or cut out pressure of the system.

Also as is well known, many pressure switches include at least two levers mechanically interposed between a pressure sensing device such as a diaphragm and the electrical contacts that are to be opened or closed. In the usual case, the levers are mechanically coupled via an over center mechanism to provide snap action opening and closing of the contacts to minimize arcing and the resulting pitting of the contacts. Needless to say, the pressure switch should have a suitable frame for pivotally mounting these levers so that the same will not bind or otherwise operate unreliably. At the same time, it is desirable that the manufacturing cost of a switch be as low as possible without sacrificing reliability. Though precision techniques are not favored because of the costs thereof, at the same time they may be required in some degree in order to achieve the desire of reliability. Obviously, inexpensive fabrication techniques that can be employed without sacrificing reliability would be highly desirable.

The present invention is directed to overcoming one or more of the above problems.

SUMMARY OF THE INVENTION

It is the principal object of the invention to provide a new and improved pressure switch. More specifically, it is an object of the invention to provide a new and improved pressure switch that provides a variety of ways of mounting an unloader valve so that the same may be readily adapted to systems of differing manufacturers, is such that an unloader valve may be readily disposed in any of a plurality of differing angular positions on the pressure switch to readily suit the particular requirements of any manufacturer; is such that the manual actuator may be mounted on either side of the switch to suit particular manufacturers requirements; includes contacts that, when closed, are at an angle greater than 0° and less than 90° to the base or frame the switch and thus, typically will be nonparallel and non-transverse to the main plane of vibration in a system in which they are mounted; and which includes a switch bracket that is formed inexpensively by stamping and bending and yet, provides the desired precision required for mounting levers, etc.

An exemplary embodiment of the invention achieves one or more of the foregoing objects in a pressure switch construction that includes a frame, a diaphragm secured to the frame and adapted to be exposed to a source of fluid under pressure and electrical contacts mounted on the frame for relative movement toward and away from each other between open and closed positions. The switch includes lever means mechanically interposed between the diaphragm and the contacts and responsive to pressure applied to the diaphragm for effecting relative movement between the switch contacts. An unloader valve is mounted on the frame and is adaptably connected to the source of pressure fluid and operable, when the contacts are in an open position, to vent fluid under pressure from the source. Means are provided to be responsive to the lever means for operating the unloader valve.

In one facet of the invention, it specifically contemplates the improvement wherein the frame is provided with at least two spaced mounting means for the unloader valve and the operating means is selectively mountable adjacent either of the mounting means.

In one form of the invention, the unloader valve includes a body having a port adapted to be connected to the source and a pilot valve adapted to be moved by the operating means. The pilot valve is accessible via a planar face abutted against the switch frame and the port opens in a direction generally parallel to the plane of the face. Each of the mounting means includes means for mounting the unloader valve with the face against the frame in any of a plurality of differing angular positions of the part relative to the frame.

In a preferred embodiment of the invention, each of the mounting means comprises an aperture in the frame through which the unloader valve may be operated and a plurality of tapped bores around the opening.

Preferably, the operating means includes a bell crank having one arm engageable by the lever means, another arm engageable with the unloader valve, and a pivot pin intermediate the arms. The frame includes two pivot pin receiving recesses, one adjacent each of the mounting means.

According to another facet of the invention, the pressure switch is such that the unloader valve has a body with a mounting face mounted against the frame and a port adapted be connected to the source of pressure fluid. The port opens from the body generally parallel to the face and means are provided for mounting the body to the frame in any of a plurality of different angular positions of the port on the frame.

According to this embodiment of the invention, a preferred embodiment, the frame, adjacent the mounting face, has an access opening to the unloader valve and the operating means operates the unloader valve through the opening. The mounting means includes a plurality of angularly spaced bores in the frame about the access opening.

In a preferred embodiment, the frame has opposite sides and each of the sides has one of the access openings and there are two such mounting means, one on each of the sides.

Again, in a preferred embodiment, the operating means comprises a bell crank and further includes means from mounting the bell crank adjacent either of the sides adjacent the corresponding access opening therein.

According to still another facet of such a pressure switch, the unloader valve includes a body having a face by which the body may be mounted to the frame and a side adjoining the face. A straight passage extends from the face into the body and has a valve seat intermediate its ends. A port is disposed in the body and extends between the passage at the end thereof remote from the face to the side and is adapted to be connected to a source of pressure fluid. A valve is located in the passage between the valve seat and the remote end and has a central opening extending there through. A poppet valve is located in the central opening and has a stem extending out of the passage into a position to be engaged by the operating means.

Preferably, the port is generally transverse to the straight passage and generally parallel to the face.

In a preferred embodiment, a mounting foot extends from the body adjacent the face and the frame includes a plurality of angularly spaced bores. A threaded fastener impales the foot and is received in any one of the bores so that the body may be mounted at a plurality of different angular positions on the frame.

At a highly preferred embodiment, there are plurality of feet on the body and the threaded fastener may be associated with any one of the feet.

In one embodiment of the invention, the frame is generally U-shaped.

Still another facet of the invention involves a pressure switch having a frame, a diaphragm secured to the frame and having one side adapted to be exposed to fluid under pressure and an opposite side, a spring acting against the opposite side in opposition to the fluid under pressure and fixed contacts mounted on the frame. A movable contact is also provided and a first lever is pivoted on the frame and mounts the movable contact for movement between electrically making and breaking positions with respect to the fixed contact. A second lever is pivoted to the frame and is linked to the diaphragm for movement therewith and an over center mechanism interconnects the first and second levers. A manual operator is provided for the second lever.

According to the invention, this facet contemplates the improvement wherein the frame has opposite sides and each of the sides includes means for mounting the manual operator so that the manual operator may be selectively mounted on either of the sides.

In a preferred embodiment, the mounting means includes a pair of operator receiving openings, one on each side of the frame.

In one aspect of the invention, the operator includes a cam for engagement with the second lever and each of the openings is partially circular over more than 180° to define a journal for the operator, and further, includes a first extension shaped like a profile of the cam.

In a preferred embodiment, each of the openings includes a second extension generally opposite the first extension. The sides of the second extension define stop surfaces and a stop is disposed on the operator engageable with either of the stopped surfaces.

Preferably, the cam and the stop are in line but axially spaced.

In a preferred embodiment, the frame is planar and the contacts are at an acute angle to the frame.

Another facet of the invention involves the improvement wherein the frame defines a mounting plane for the switch and there are two spaced fixed contacts and the movable contact is elongated and arranged to bridge the fixed contacts. The movable contact has its axis of elongation at an acute angle greater than 0° and less than 90° to the mounting plane when in the electrically making position.

Preferably, the acute angle is at least about 10° and no more than about 80°.

Another facet of a pressure switch as set forth above includes the improvement, which includes an adjustable stop on the frame for selectively limiting the movement of the movable contact toward the electrical breaking position.

Preferably, the switch includes a contact module on the frame and the stop is adjustably mounted on the module for selective positioning in a plurality of positions in the path of movement of the first lever.

The invention further contemplates that the stop include a threaded member carrying a stop surface disposed to engage the first lever. The threaded member is received in a threaded bore in the contact module.

In a highly preferred embodiment, the switch includes a contact module mounted on the frame and which mounts both the first and second levers. The adjustable stop is mounted on the module to be movable between a plurality of positions in the path of movement of the first lever for limiting movement thereof toward the electrical breaking position. A pin is mounted for movement in the path of movement of the second lever to be engaged thereby as the contacts move toward the electrical breaking position. A spring is provided for biasing the pin toward the second lever and means are provided for adjusting the bias supplied by the spring.

The invention contemplates that the contact module include a generally U-shaped bracket having a bight with straight, unbent spaced legs terminating in oppositely directed feet and formed by bending a piece of metal along with an insulating arc box secured to the bracket. The levers are pivoted between the legs of the bracket and the arc box carries the fixed contacts and is mounted over the bight. The legs have shoulders adjacent the bight and adjacent the feet and on the straight unbent parts thereof. The spacing between the shoulders on one leg is identical to the spacing between the corresponding shoulders on the other leg. The shoulders adjacent the bight engage the arc box to position the same and the shoulders adjacent the feet engage the frame so that the legs are relatively precisely aligned with one another in spite of irregularities in the bending of the metal piece.

Another facet of the invention contemplates a pressure switch having a frame with a diaphragm mounted on the frame and having one side adapted to be subjected to pressurized fluid. A bracket is mounted on the frame oppositely of the diaphragm and mounts a spring in opposition to the diaphragm. At least one contact moving lever is coupled to the diaphragm and a fixed electrical contact is provided. The invention contemplates the improvement wherein the bracket is U-shaped and has a bight connected by bends to straight unbent legs, the legs terminating in feet connected thereto by bends and mounted to the frame. The legs, at both ends thereof, and at locations before the bends connecting the legs to the bight and the feet, have stamped shoulders with the spacing between the shoulders on one leg equalling the spacing between the shoulders on the other leg. The fixed electrical contact is positioned by the shoulders of both legs adjacent the bight while the lever is journalled in journal openings stamped in the legs and is positioned by the shoulders of both legs adjacent the feet engaging the frame.

In a preferred embodiment, there are first and second levers interconnected by an over-center mechanism. Both of the levers are journalled in stamped journal openings in the legs and the first lever is coupled to the diaphragm and the second lever carries a movable contact for movement toward and away from the fixed contact.

Preferably, the frame itself includes aligned openings and the legs have unbent projections adjacent to the feet that extend into the openings past the shoulders adjacent the feet to properly space the legs.

Other objects and advantages of the invention will become apparent from the following specification taken in connection with the accompanying drawings.

DESCRIPTION OF THE DRAWINGS

FIG. 3 is an end view of the pressure switch with parts shown in section for clarity;

FIG. 4 is a sectional view of an unloader valve used with the switch with the components in the orientation they would assume after venting pressure fluid from a positive displacement machine;

FIG. 5 is a view similar to FIG. 4 but showing the valve components in the configuration they would assume when the unloader valve is wholly closed;

FIG. 6 is a view similar to FIGS. 4 & 5 but showing the position of the components as the unloader valve is about to open;

FIG. 7 is an elevation of the exterior of the unloader valve;

DESCRIPTION OF THE PREFERRED EMBODIMENTS

Figure 1:
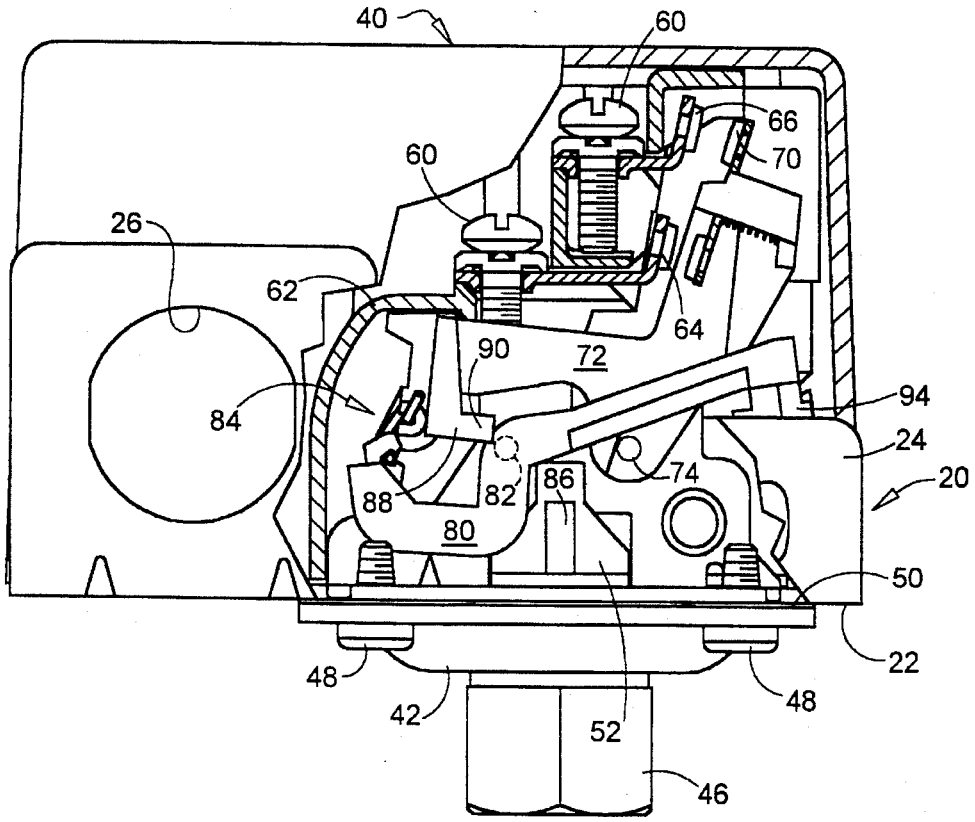
FIG. 1 is a partial side elevation, partial section, of one embodiment of a pressure switch made according to the invention.

An exemplary embodiment of a pressure switch is illustrated in the drawings. It is to be understood that the pressure switch of the present invention may be used in fluid handling systems where the fluid is either liquid or gaseous, even though, in the following description, the pressure switch will frequently be referred to as in the environment of an air compressor.

Figure 2:
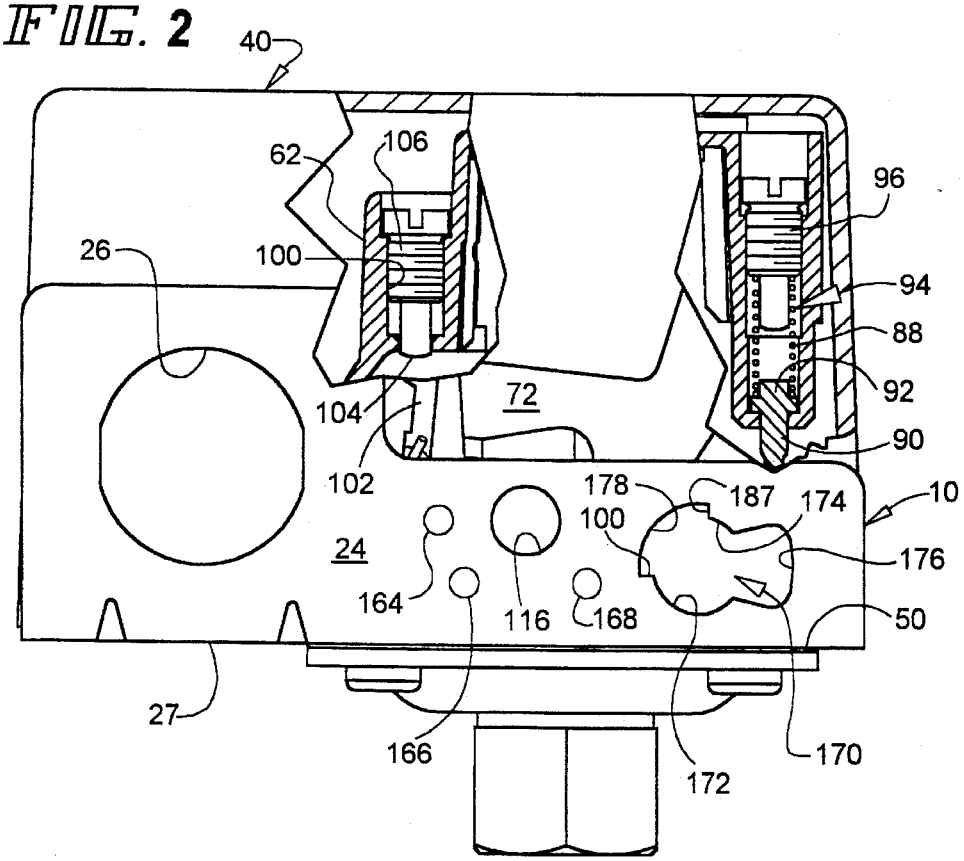
FIG. 2 is a view similar to FIG. 1, but showing different components in section.
Figure 8A:
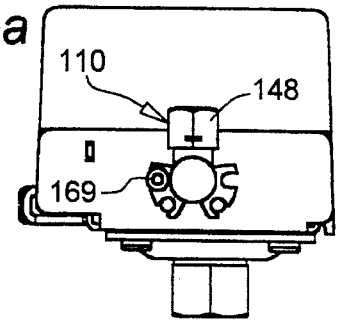
FIGS. 8(*a*)–8(*h*) collectively illustrate a variety of positions for mounting the unloader valve on either one of two sides of the pressure switch in any of a plurality of positions on each side.
Figure 8E:
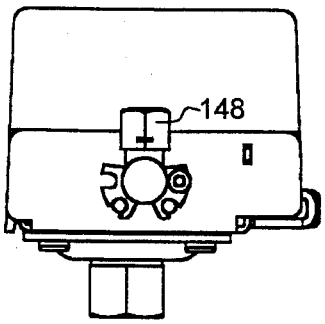
Figure 8B:
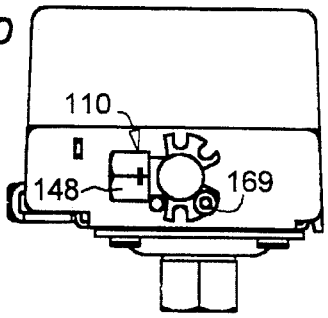
Figure 8F:
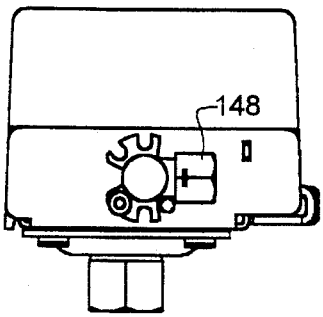
Figure 8C:
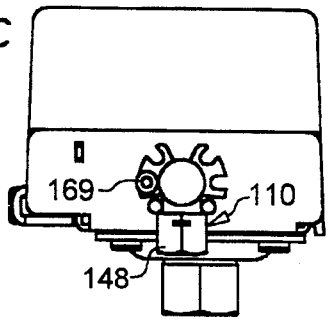
Figure 8G:
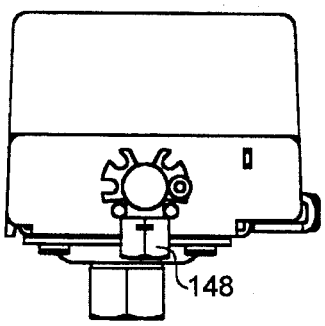
Figure 8D:
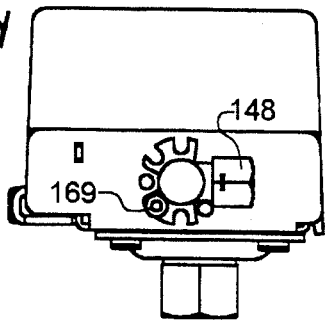
Figure 8H:
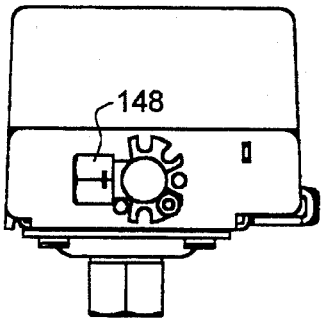
Figure 9:
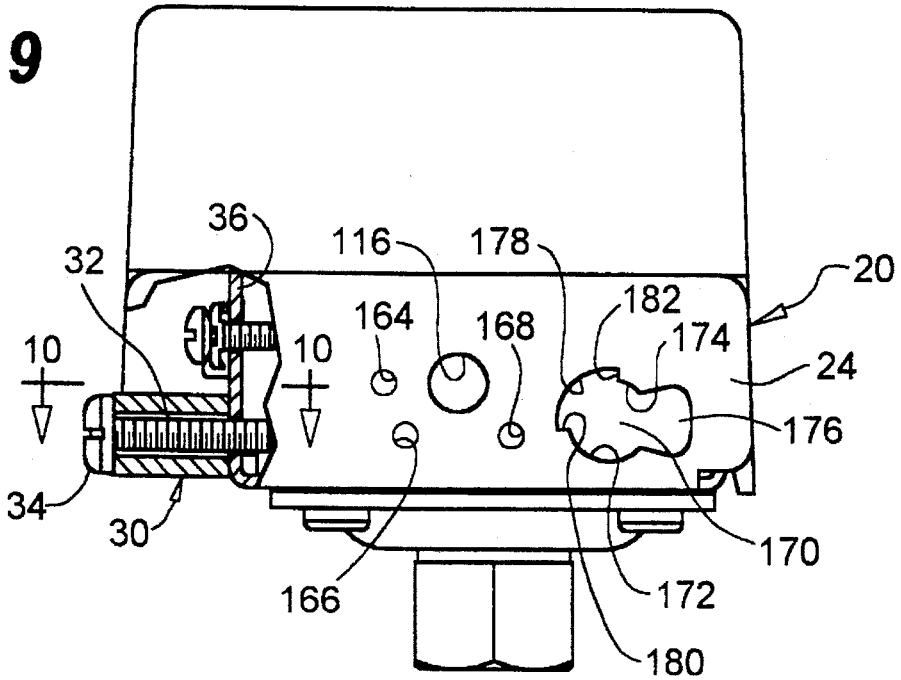
FIG. 9 is an elevational view with part of a cable clamp shown in section.
Figure 10:
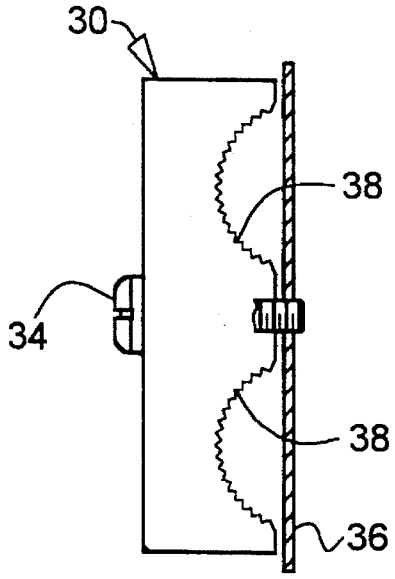
FIG. 10 is a fragmentary sectional view taken approximately along the line 10—10 in FIG. 9.

Referring to FIG. 1, the pressure switch includes a frame, generally designated 20. The frame 20 is generally U-shaped,, having a bight 22 (FIG. 3) and two upstanding sidewalls or legs 24. As seen in FIGS. 1 and 2, each of the upstanding sidewalls 20 includes an aperture 26 for receipt of a conduit coupling sleeve as is well known. Alternatively, cable clamping bars such as shown in FIGS. 9 and 10 may be used. The cable clamping bar is generally designated 30 and includes a central aperture 32 for receipt of a screw 34 by which the same may be secured to an upstanding end 36 of the frame 20. The clamping bar 30 includes a pair of half circle recesses 38 which open toward the wall 36. As seen in FIG. 10, the recesses 38 are serrated so as to clamp against a cable and firmly hold the same against the frame 20.

Returning to FIGS. 1–3, the switch also includes a cover, generally designated 40, which forms no part of the invention and may otherwise be conventional. Oppositely of the cover 40, the frame 20, on the bight 22, mounts a diaphragm enclosure 42 having one or more ports 46 adapted to be connected to the pressure source to be monitored. The diaphragm enclosure 42 is secured to the bight 22 by mounting screws 48 and sandwiches a diaphragm 50 against the underside of the bight 22. An aperture (not shown) is located in the bight 22 as is well known and a conventional dome 52 abuts the side of the diaphragm 50 opposite the port 46 and is movable within the switch.

An inverted U-shaped bracket 53, to be described in greater detail hereinafter, is located within the switch and mounts a compression coil spring 54. A pusher plate 56 is mounted on the threaded end 58 of a rod 60 that extends upwardly through the spring 54 to terminate in a screw head (not shown) just above the bracket 52. By turning the screw head, the degree of compression of the spring 54 may be adjusted.

The rod 60 contacts the dome 52. Thus, the spring 54 provides a biasing force against the diaphragm 50 in opposition to the pressure applied to the diaphragm from a source connected to the port 46.

It is to be noted that in the switch of the present invention, the spring 54 directly biases the dome 52 in contrast to prior art constructions wherein the spring physically biases a pivoted lever, which in turn bears against the dome 52.

Within the cover 40 is an arc box 62 made of any suitable insulating material. As illustrated in FIG. 1, a pair of spaced fixed electrical contacts 64 and 66 are mounted on the arc box 62. Each of the contacts 64 and 66 extends to a terminal screw 68. An elongated movable contact 70 is also located within the switch and is movable toward and away from the contacts 64, 66. It is operable to bridge the two and thus complete a circuit. The movable contact 70 is carried by a first lever 72 pivotally mounted by pivot pins 74 journalled in the bracket 53 for rotation about a horizontal axis. In the usual case, the lever 72 will in fact be a bale having two arms as seen in FIG. 1, one on each side of the bracket 53. It will mount two of the movable contacts 70 and the arc box 62 will mount two each of the contacts 64 and 66 on opposite sides of the switch.

A second lever 80 is pivoted by pivots 82 to the bracket 53. An over-center mechanism, generally designated 84, interconnects adjacent ends of the lever 72 and 80. The over-center mechanism 84 may be conventional. One preferred form involves the use of a spring such as illustrated in commonly assigned U.S. Pat. No. 4,868,356, issued Sep. 19, 1989, to Lindsey, et al., the details of which are herein incorporated by reference.

Tabs 86 at opposite sides of the dome 52 may engage the second lever 80 just to the right of the pivot pins 82 as viewed in FIG. 1 in response to increasing pressure applied at the port 46 to cause the lever 80 to pivot in a generally counter-clockwise direction. Assuming that the lever 72 has previously been moved counter-clockwise from the position illustrated in FIG. 1 to cause the contact 70 to bridge the contacts 64 and 66, continued pivotal movement of the second lever 80 in a clockwise direction will result in the over-center mechanism 84 going over-center which in turn will cause the first lever 72 to snap in a clockwise direction, thereby moving the movable contacts 70 from a closed or electrically making position to an open or electrically breaking position. The latter is illustrated in FIG. 1.

The second lever 80, like the first lever 72, is in fact a bale having identical arms as shown in FIG. 1 on opposite sides of the switch. It is to be particularly noted that each of the arms of the lever 72 includes an outwardly extending L-shaped tab 88 provided with an actuator surface 90 for purposes to be seen.

Turning now to FIG. 2, it is important that pressure switches be provided with a differential mechanism. In particular, it is necessary in, for example, air compressor operations that the circuit be broken at a higher pressure than the pressure at which the circuit closes to start the compression of air. The previous description of the operation of an air compressor cycle makes this clear; and a differential mechanism may be employed to set the differential between the two pressures, the cut out pressure and the cut in pressure corresponding to open and closed circuits respectively.

To this end, the arc box 62 includes an integral barrel 88. A pin 90 having an enlarged head 92 within the barrel 88 extends into engagement with a cross bar 94 (FIG. 1) interconnecting opposed parts of the second lever 80. Within the barrel 88 is a compression coil spring 94 which acts against the head 92 to bias the pin 90 toward the cross bar 94. Near its upper end, the barrel 88 is threaded and receives an adjustment screw 96 whereby the bias applied to the head 92, and thus the pin 90, can be selectively adjusted. Through appropriate operation of the adjusting screw 96, the cut out pressure of the switch may be set.

According to the invention, the differential mechanism may include a second adjustment in the form of a threaded bore in the arc block 62 oppositely of the barrel 88. The threaded bore 100 overlies a cross bar 102 on the lever 72 and associated with the over-center mechanism 84. A stop surface 104 extends from the bore 100. The stop surface 104 is on the end of an adjustment screw 106 and threaded into the bore 100. The stop 104 is in the path of movement of the cross-bar 102 of the first lever 72 and sets a stop to limit movement of the movable contact 70 away from the closed position, that is, toward the open position. This stop may be utilized to adjust the cut in pressure of the switch. It is desirable from the standpoint that adjustment of the cut in pressure means an adjustment of the differential pressure without altering the range over which the switch is operative and intended to monitor. Consequently, if the switch is preset to have a cut-out pressure of, say, 100 lbs. per square inch, that pressure will remain the same even though the differential pressure is adjusted, so long as the adjustment is effected using the adjusting screw 106.

Turning now to FIG. 3, a further feature of the invention will be described. As illustrated therein, each of the sidewalls 24 of the frame 20 mounts an unloader valve, generally designated 110. In fact, in the usual case, only one of the unloader valves 110 will be provided. The point of FIG. 3 is to illustrate that the unloader valve 110 may be mounted on either side of the pressure switch to provide manufacturing flexibility.

The details of each unloader valve will be described shortly but for present purposes, it is sufficient to note that each includes a port 112 which is adapted to be connected to the point in the system whose pressure is to be relieved. Typically, this will be the compression chamber of a positive displacement machine such as a compressor.

The unloader valve includes a pilot valve stem 114 that extends into the switch in part through an opening 116 (see FIG. 2) in each of the sidewalls 24. Assuming the unloader valve 110 is closed, pushing the stem 114 into the unloader valve will cause the unloader valve 110 to open.

According to the invention, this is achieved by use of a bell crank, generally designated 118. The bell crank 118 includes a central pivot pin 120 and first and second levers arms 122 and 124 extending therefrom. The arm 122 is positioned to engage the valve stem 114 as illustrated in FIG. 3 while the arm 114 overlies the actuating surface 90 of the L-shaped tab 88 on the first lever 72 (FIG. 1).

Returning to FIG. 1, it will be appreciated that when the switch is opened, the first lever 72 pivots in a clockwise direction which in turn causes the actuating surface 90 to move upwardly as viewed in FIG. 1. This in turn will cause the left hand bell crank 118 to pivot in a clockwise direction about its pivot 120 to push the valve stem 114 into the unloader valve 110 and cause the same to open. If the unloader valve 110 is mounted on the right hand side of the pressure switch as viewed in FIG. 3, the upward movement of the actuating surface 90 will cause the right hand bell crank 118 to pivot in a counter-clockwise direction and again the valve stem 114 will be pushed into the unloading valve 110 to open the unloader valve.

Figure 11:
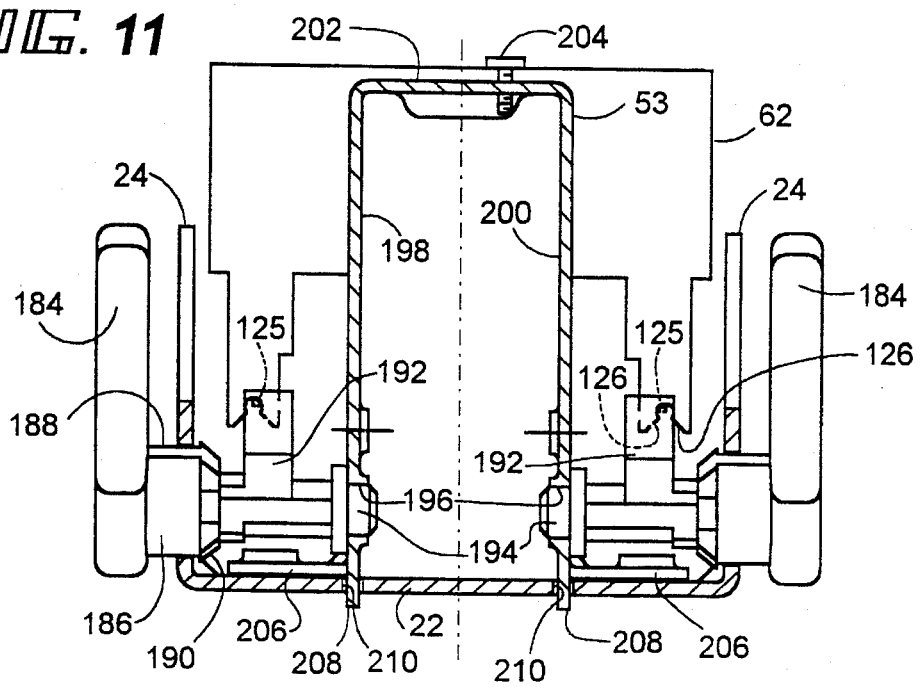
FIG. 11 is a partial sectional view of the switch from one end thereof.

In a preferred embodiment, the journals for the pivot pins 120 are formed by downwardly opening recesses 125 (FIG. 11) in a downwardly facing surface of the arc box 62. As can be seen in FIGS. 3 and 11, converging surfaces 126 on opposite sides of the pivot pins 120 provide pilots for piloting the pivot pin 120 into a recess 125 whose mouth is slightly smaller than the pin 120 so that the later may be snap fit retained therein.

FIGS. 4, 5 and 6 illustrate, in greater detail, the construction of each unloader valve 110. Each includes a body which is made up of an outer body section 130 and an inner body section 132. The inner body section 132 includes a passage 134 terminating in an opening 136 through which the plunger 114 may extend. The passage 134 includes an internal step 138 which is a valve seat for a valve 140. The valve 140 includes a central passage 142 through which the stem 114 extends to terminate in a poppet 144 which may close the internal passage 142 and seat is against the valve 140 as indicated in FIGS. 4 and 5.

The inner body 132 terminates just short of an end of internal cavity 146 in the outer body 130 and thus, provides a passageway for fluid flow to a port 148 in the outer body 130, and specifically, in a side thereof. The port 148 is generally transverse to the passage 136 as can be plainly seen in FIGS. 4–6 and is adapted to be connected by any suitable means to the pressure source to be vented as, for example, the compression chamber of a compressor as noted previously.

The unloader valve also includes a side exit port 150 defined by aligned openings in the inner body 132 and the outer body 130 and which is in fluid communication with passage 134.

The construction is completed by a spring 152 within the passage 134 which biases the valve 140 away from the seat 138, that is, toward the position illustrated in FIG. 4.

FIG. 4 illustrates the orientation of the components in what might be termed as a starting condition. At this time, no pressure fluid is being applied to the port 148. The valve 140 will be opened while the poppet 144 will be closed.

Upon start up of a positive displacement machine whose compression chamber is connected to the port 148, the pressure fluid will enter the valve and be applied to the left hand side of the valve 140. The pressurized fluid will drive the valve 140 against the bias of the spring 152 to the position illustrated in FIG. 5. In this position, the valve 140 is closed against the seat 138 while the poppet 144 will be closed against the valve 140. As a consequence, pressurized fluid will not be vented through the unloading valve 110 at this time.

When the cut out pressure is attained, the resulting opening of the contacts by clockwise movement of the first lever 72 as viewed in FIG. 1 will cause the operator surface 90 to pivot the bell crank 118 to the position illustrated in FIG. 6. The arm 122 will drive the valve stem 114 inwardly into the valve 110. This will unseat the poppet 144 and allow fluid communication between the port 148 and the port 150. It will tend to cause equalization of biasing forces due to fluid pressure on opposite sides of the valve 140. As a consequence, the spring 152 will cause the valve 140 to be returned to the position illustrated in FIG. 4. This in turn allows complete venting to occur past the valve 140 so as to, for example, reduce the start up load for the positive displacement machine the next time a cut in pressure is attained.

Desirably, the inner body 132 may be made of a plastic material. Its side may be provided with peripheral barbs 154 which provide a plurality of sealing points to achieve a good seal of the outer body 130 to the inner body 132 while, at the same time, providing a very economical construction.

An important feature of the unloading valve 110 is the fact that it includes a planar face 156. A piloting nose 158 on the inner body 132 extends from the planar face 156 and is adapted to pilot and locate the unloader valve properly within the opening 116 (FIG. 2) in the selected sidewall 24.

As can be seen in FIG. 7, a pair of feet 160 extend from the outer body 130 in nominally opposite directions. Each of the feet 160 includes a pair of recesses 162. Returning to FIG. 2, it will be seen that about the opening 116 there are a plurality of at least three tapped bores 164, 166 and 168. A single threaded fastener 169 (FIGS. 8*a*–8*d*) is adapted to be extended through any selected one of the recesses 162 into any selected one of the tapped bores 164, 166, 168 to secure the unloader valve 110 to the desired side of the housing as shown in FIG. 3. The use of the angularly spaced recesses 162 and angularly spaced tapped bores 164, 166 and 168, and the provision of such mounting means on both of the side walls 24 allows the unloader valve to be mounted in any of a plurality of positions as illustrated in FIGS. 8A–8H, inclusive, on either side of the pressure switch. Note that the port 148, which opens parallel to the planar face 156, can be directed upwardly, downwardly, to the right or to the left as desired. Consequently, the pressure switch is ideally suited for use by different manufacturers who may have system components located in different relative positions because the port 148 may be located to face the compressor or whatever position is most convenient or most efficient for connection to such compression chamber.

As alluded to previously, another feature of the invention involves the ability to place a manual actuator for the switch on either side of the same. To this end, each of the sides 24 is provided with an opening 170 as seen in FIGS. 2 and 9. The opening 170 includes a central, circular part made up of two segments 172 and 174, which collectively have an arc length somewhat greater than 180°. The same thus serve, as will be seen, as a journal for a manual operator.

A first extension 176 extends in one direction from the central part and, as will be seen, has a profile of a cam surface on a manual actuator, although the same is somewhat larger than the cam surface.

Oppositely of the first extension 176 is a second extension 178. In a preferred embodiment, the extension 178 has an arc length of 90° and its sides 180 and 182 define stop surfaces.

Figure 12:
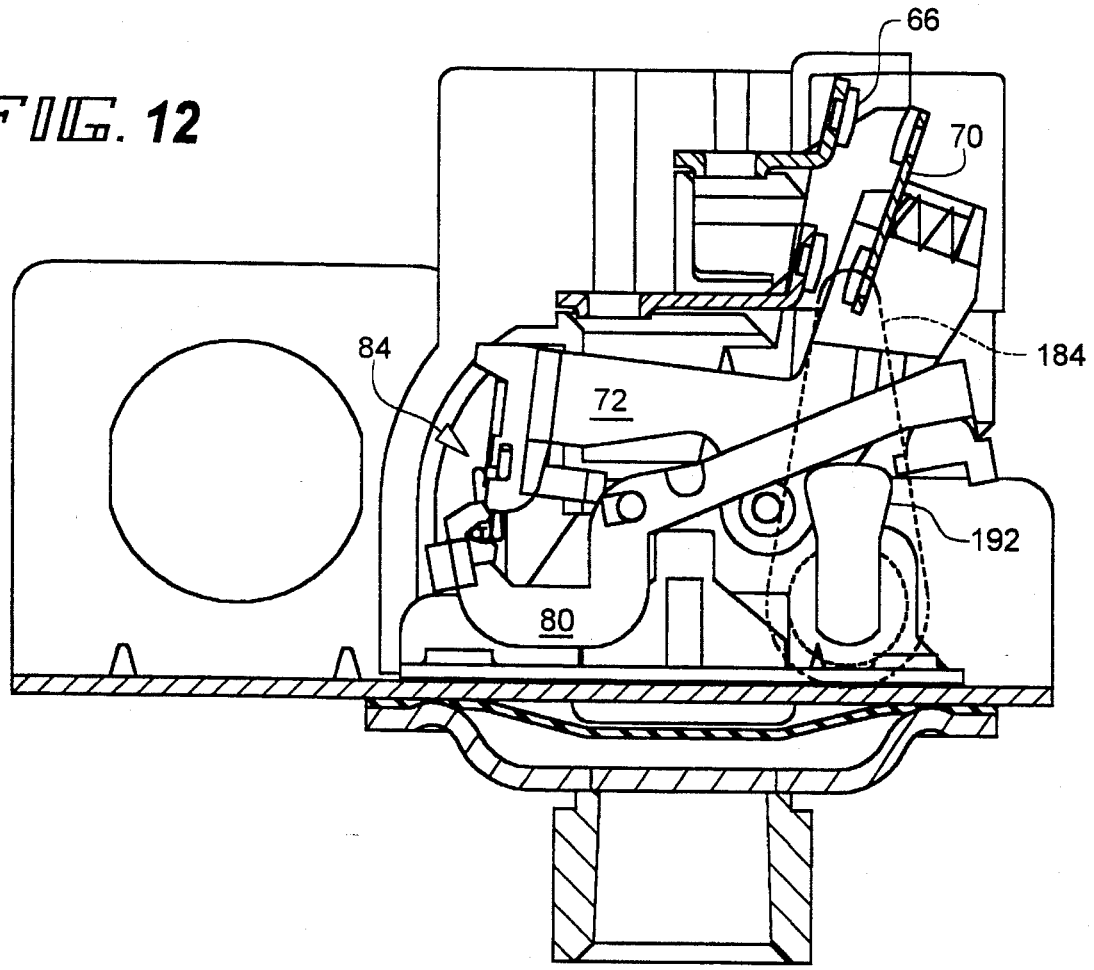
FIG. 12 is a side view of the pressure switch showing a manual component for manually opening the contacts of the switch and with parts shown in section.
Figure 13:
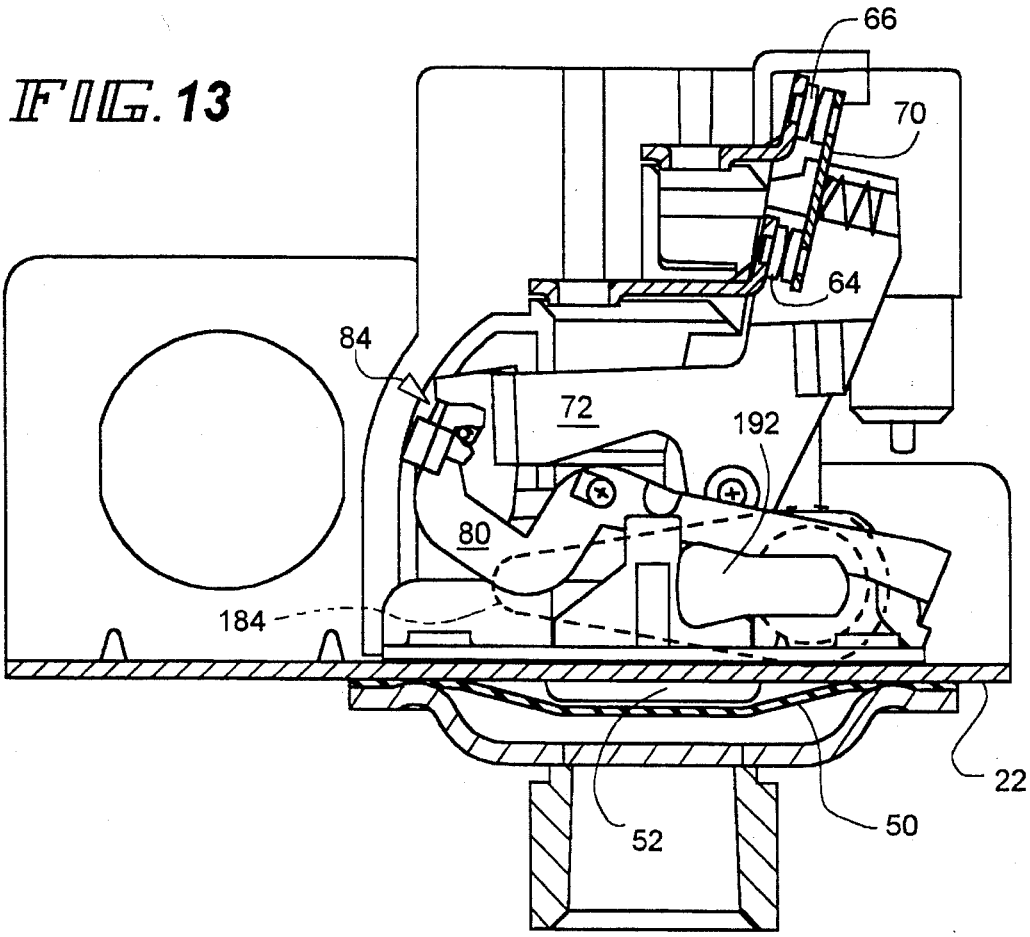
FIG. 13 is a view similar to FIG. 12, but showing the arrangement of the components when the switch has been closed.

A manual actuator that may be employed as illustrated FIGS. 11, 12 and 13. The same includes a handle 184 shown in solid lines in FIG. 11 and in dotted lines in FIGS. 12 and 13. A first journal 186 extends from the handle and is relatively large. The same includes an radially extending ridge 188 and three or four radially extending fingers 190 whose radially extent is slightly greater than the diameter of the central section of the opening 170 defined by the segments 172 and 174.

A cam 192 is located inwardly of the first journal 186 and has a configuration illustrated in solid lines in FIGS. 12 and 13. It will be observed that the cam surface 192 has the same profile as the first extension 176 (FIGS. 2 and 9) but is slightly smaller.

Still further inwardly, each manual actuator includes a second journal 194 which is received in a punched opening 196 in a corresponding leg 198 or 200 of the bracket 53.

It will thus be seen that the manual actuator may be assembled to the device simply by aligning the cam 192 with the extension 176 and axially advancing the operator into the switch. Once the cam 192 is located within the corresponding side wall 124, the operator may be rotated so as to allow the axially extending ledge 188 to align with the extension 178. Further advancement of the operator into the switch will cause the second journal 194 to be received in the stamped opening 196 in the bracket 53. The fingers 190 will elastically deform and advance through the opening 170 to be on the side of the sidewall opposite the handle 184 and thus serve as a means for retaining the operator in place. At this point, the ledge 188 will be disposed within the second extension 178 in a position to abut either one of the stop surfaces 180 or 182 and thus serve as a limitation on the degree of rotation of each manual actuator. The first journal 186 will, of course, be rotatably received within the segments 172 and 174 of the opening 170.

The cam 192, at this time, will underlay the second lever 80. Consequently, if the handle 184 is moved to the position illustrated in FIG. 2, the cam 192 will pivot the arm 80 in a counter clockwise direction which in turn will cause the lever 72 to pivot in a clockwise direction and open the contacts. On the other hand, when the handle is pivoted to the position illustrated in FIG. 13, the second lever 80 may pivot in a clockwise direction to the position illustrated in FIG. 13. If the same is permitted to pivot to that point, something that will not normally occur, but could be made to occur if a biasing spring were employed to bias the second lever 80 in the clockwise direction, the same may go over center with relation to the first lever 72 and cause the same to snap to the position illustrated in FIG. 13 wherein the movable contact 70 bridges the fixed contact 64 and 66.

Before leaving FIG. 11, it is worth noting that the arc box 62 is mounted to the bight 202 of the bracket 53 by means of a screw 204. It is also worthy of note that each of the legs 198 and 200 of the bracket 53 terminate in outwardly directed feet 206 and 208, respectively, which are secured to the bight 22 of the frame 20 by threaded fasteners which have been omitted for clarity.

It is also worthy of note that the lower ends of the legs 198 and 200 each include locating extensions 208 that extend into apertures 210 in the bight 22 of the frame 20. This construction serves to precisely space the legs 198 and 200 with respect to each other.

Figure 14:
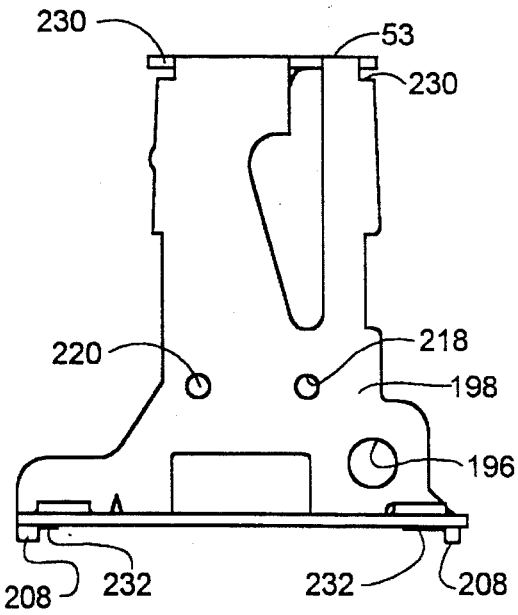
FIG. 14 is a side elevation of a bracket used in forming the switch.
Figure 15:
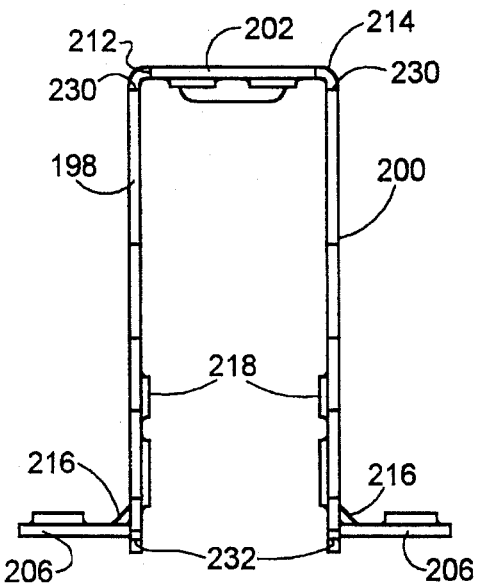
FIG. 15 is a view of the bracket taken from the right side of FIG. 14.

Turning now to FIGS. 14 and 15, the bracket 53 will be described in greater detail. As can be best appreciated from FIG. 15, the bight 202 is connected to each of the legs 198, 200 by a respective bend 212, 214. Similarly, the feet 206 are connected to the respective legs 198, 200 by bends 216.

This is accomplished through typical forming processes by bending a sheet of metal. Prior to the bending, the same is stamped with journal openings 196 as well as pivot pin receiving openings 218 and 220 for the pivot pins 74 and 82 respectively for the first and second levers 72 and 80.

It will be readily appreciated that the pivots 218 and 220 in both legs 198, 200 must be relatively precisely aligned if binding of the lever 72, 80 is to be avoided. It will also be appreciated that precise alignment is extremely difficult to achieve in a bending operation. Thus, according to the invention, during the stamping process, and before the bending, in the straight unbent portions which ultimately define the legs 198 and 200, a pair of shoulders 230 are formed closely adjacent the bends 212 and 214 in each of the legs 198 and 200. Similarly, shoulders 232 are formed at the opposite ends of each of the legs 198 and 200, in the straight end unbent portions thereof closely adjacent to bends 216.

Consequently, when the bracket 53 is installed to the frame 20, the feet 206 may be pulled tightly there against but the ultimate positioning of the legs 198 and 200 will be dependent upon the abutment of the shoulders 232 against the bight 22 of the frame 20, as well as the fact that the projections 208 will enter locating holes in the bight 22. In this respect, as can be seen in FIGS. 14 and 15, the shoulders 232 are slightly below the bottom surface of the feet 206.

Because the shoulders 232 are formed by stamping as are the journals 218 and 220, their relative locations are fairly precisely determined and since no bending operation intervenes between these components, that precise relative location will be maintained at all times. Thus, by having the shoulders 232 abutting the bight 22 of the frame 20, and by having the locating projections 208 in holes in the bight 22, sufficiently precise alignment of the pivots 218 and 220 with respect to each other is sufficient to prevent binding can be achieved.

In order to obtain precise location of other components, it will be noted that construction of the arc box 62 is such that it seats against the shoulders 230 on the bracket 53 as opposed to the bight 220. The same is merely secured to the latter but is not necessarily seated thereon. As a consequence, the same sort of precision can be obtained because the shoulders 230 are formed during the stamping operation and are in unbent segments of the legs 198 and 200. Further, precise positioning between components is enhanced by making the distance between the shoulders 230 and 232 on one of the legs 198 equal to the spacing between the shoulders 230 and 232 on the leg 200 a well as by locating the journals on each leg the same distance from the respective shoulders. Thus, relatively precise positioning of the fixed contacts 64, 66 which are carried by the arc box 62 with relation to the movable contact 70, which is carried by the first lever 72 which in turn is mounted on the bracket 53, can be obtained.

Returning to FIG. 13, it will be noted that the bight 22 of the frame 20 defines a mounting plane in that the same is relatively planar in configuration. In the usual case, the pressure switch will be mounted in a system such that the plain bight 22 will either be parallel to the direction of reciprocation of, for example, the piston of a compressor or at right angles thereto.

According to the invention, the arrangement of the contacts 64, 66 and 70 is such that when in the closed position illustrated in FIG. 13, they are at an acute angle more than 0° less than 90° to the mounting plane defined by the bight 22. As a consequence, the contacts will not be in the main plane of vibration of the machine. As a result of that, contact chatter and premature wear and/or pitting and arcing are minimized.

In a highly preferred embodiment, the angle is more than 10° and less than 80° then in the embodiment illustrated, a 13° degree angle is employed in relation to a line transverse to the plane of the bight 22. While an angle of 45° would be optimum, frequently space constraints require the use of a lesser angle which accounts for the use of a 13° angle in a preferred embodiment.

From the foregoing, it will be appreciated that a pressure switch according to the invention, in its many facets, is a significant improvement. The unique means of mounting an unloader valve so that the same may be located on the pressure switch on any of a variety of sides to readily accommodate different component orientations in fluid processing systems of different manufacturers, or the ability to mount the unloader valve in a plurality of angular positions on the pressure switch for the same purpose, or both, result in a pressure switch that may be inexpensively manufactured in a way such that one model essentially fills all needs.

The same may be said for the provision of the manual actuator which may be readily disposed at any one of a plurality of locations on the pressure switch to again readily suit the particular requirements of any manufacturer.

The provision of contacts that are mounted at an angle when closed so as to be out of the main plane of vibration increases the life and reliability of the switch. The use of a bent switch bracket facilitates inexpensive manufacturing while at the same time, the unique use of shoulders on unbent parts of the switch bracket assures that corresponding parts will align to avoid problems such as binding. Thus, reliability with inexpensive construction is assured.

I claim:

1. In a pressure switch, including a frame, a diaphragm secured to the frame and adapted to be exposed to a mechanical source of fluid under pressure, electrical contacts mounted on the frame for relative movement toward and away from each other between open and closed positions; and lever means mechanically interposed between said diaphragm and said contacts and responsive to pressure applied to said diaphragm for effecting said relative movement, an unloader valve mounted on said frame and adapted to be connected to said source and operable, when said contacts are in an open position to vent fluid under pressure from said source, and means, responsive to said lever means, for operating said unloader valve, the improvement wherein said frame is provided with at least two spaced mounting means for said unloader valve, and said operating means is selectively mountable adjacent either of said mounting means, said unloader valve, including a body having a port adapted to be connected to said source and a pilot valve adapted to be moved by said operating means, said pilot valve being accessible via a planar face abutted against said frame, said port opening in a direction generally parallel to the plane of said face, and each of said mounting means including means for mounting said unloader valve with said face against said frame in any of a plurality of differing angular positions of said port relative to said frame.

2. The pressure switch of claim 1 wherein each of said mounting means including said means for mounting in a plurality of differing angular positions comprises an aperture in said frame through which said unloader valve may be operated, and a plurality of bores around said aperture.

3. In a pressure switch, including a frame, a diaphragm secured to the frame and adapted to be exposed to a mechanical source of fluid under pressure, electrical contacts mounted on the frame for relative movement toward and away from each other between open and closed positions; and lever means mechanically interposed between said diaphragm and said contacts and responsive to pressure applied to said diaphragm for effecting said relative movement, an unloader valve mounted on said frame and adapted to be connected to said source and operable, when said contacts are in an open position to vent fluid under pressure from said source, and means, responsive to said lever means, for operating said unloader valve, the improvement wherein said frame is provided with at least two spaced mounting means for said unloader valve, and said operating means is selectively mountable adjacent either of said mounting means and wherein said operating means includes a bell crank having one arm engageable by said lever means, another arm engageable with said unloader valve, and a pivot pin intermediate said arms, and said frame includes two pivot pin receiving recesses, one adjacent each of said mounting means.

4. In a pressure switch, including a frame, a diaphragm secured to the frame and adapted to be exposed to a mechanical source of fluid under pressure, electrical contacts mounted on the frame for relative movement toward and away from each other between open and closed positions; and lever means mechanically interposed between said diaphragm and said contacts and responsive to pressure applied to said diaphragm for effecting said relative movement, an unloader valve mounted on said frame and adapted to be connected to said source and operable, when said contacts are in an open position to vent fluid under pressure from said source, and means, responsive to said lever means, for operating said unloader valve, the improvement wherein said unloader valve has a body with a mounting face mounted against said frame, and a port adapted to be connected to said source, said port opening from said body generally parallel to said face, and means for mounting said body to said frame in any of a plurality of different angular positions of said port at a single location on said frame.

5. The pressure switch of claim 4 wherein said frame, adjacent said mounting face, has an access opening to said unloader valve at said single location and said operating means operates said unloader valve through said opening, and said mounting means includes a plurality of angularly spaced bores in said frame about said access opening.

6. The pressure switch of claim 5 wherein said frame has opposite sides and wherein one of said sides has said access opening and another access opening is located in the other of said sides and there are two said mounting means, one on each of said sides said unloader valve being mounted adjacent a selected one of said access opening and said another access opening.

7. The pressure switch of claim 6 wherein said operating means comprises a bell crank and further including means for mounting said bell crank adjacent either of said sides adjacent the corresponding access opening therein.

8. In a pressure switch, including a frame, a diaphragm secured to the frame and adapted to be exposed to a mechanical source of fluid under pressure, electrical contacts mounted on the frame for relative movement toward and away from each other between open and closed positions; and lever means mechanically interposed between said diaphragm and said contacts and responsive to pressure applied to said diaphragm for effecting said relative movement, an unloader valve mounted on said frame and adapted to be connected to said source end operable, when said contacts are in an open position to vent fluid under pressure from said source, and means, responsive to said lever means, for operating said unloader valve, the improvement wherein said unloader valve includes a body having a face by which the body may be mounted to said frame and a side adjoining said face, a straight passage extending from said face into said body, a valve seat intermediate the ends of said straight passage, a port in said body extending between said passage at the end thereof remote from said face to said side and adapted to be connected to said source, said port being generally transverse to said straight passage and generally parallel to said face, a valve in said passage between said valve seat and said remote end, and having a central opening extending there-through, and a poppet valve in said central opening and having a stem extending out of said passage into a position to be engaged by said operating means;

a mounting foot extending from said body adjacent said face;

said frame including a plurality of angularly spaced bores; and a threaded fastener impaling said foot and receivable in any one of said bores whereby said body may be mounted in a plurality of different angular positions on said frame.

9. The power switch of claim 8 wherein said mounting foot comprises a plurality of feet on said body and said threaded fastener may be associated with any one of said feet.

10. In a pressure switch including a frame, a diaphragm secured to said frame and having one side adapted to be exposed to fluid under pressure and an opposite side, a spring acting against said opposite side in opposition to said fluid under pressure, a fixed contact mounted on said frame, a movable contact, a first lever pivoted on said frame and mounting said movable contact for movement between electrically making and breaking positions with respect to said fixed contact, a second lever pivoted to said frame and linked to said diaphragm for movement therewith, an over center mechanism interconnecting said first and second levers and defining an over center position for said first and second levers, and a manual operator that may be manually moved to apply a moving force to said second lever to move said second lever through said over center position, the improvement wherein said frame has opposite sides and each of said sides includes an opening for rotatably mounting and journalling said manual operator so that said manual operator may be selectively mounted on either of said sides.

11. The pressure switch of claim 10 wherein said operator includes a cam for engagement with said second lever and each said opening is partially circular over more than 180° to define a journal for said operator and further includes a first extension shaped like a lever engaging profile of said cam.

12. The power switch of claim 11 wherein each said opening includes a second extension generally opposite of said first extension, sides of said second extension defining stop surfaces, and a stop on said operator engageable with either of said stop surfaces.

13. The power switch of claim 12 wherein said cam and said stop are in line but axially spaced.

14. The power switch of claim 10 wherein said frame has a planar section and said contacts are at an acute angle to said frame planar section.

15. In a pressure switch including a frame, a diaphragm secured to said frame and having one side adapted to be exposed to fluid under pressure and an opposite side, a spring acting against said opposite side in opposition to said fluid under pressure, a fixed contact mounted on said frame, a movable contact, a first lever pivoted on said frame and mounting said movable contact for movement between electrically making and breaking positions with respect to said fixed contact, a second lever pivoted to said frame and linked to said diaphragm for movement therewith, and an over center mechanism interconnecting said first and second levers, the improvement comprising an adjustable stop on said frame for selectively limiting the movement of said movable contact toward said electrical breaking position;

said switch including a contact module mounted on said frame and mounting both said first and second levers; said adjustable stop being mounted on said module to be movable between a plurality of positions in the path of movement of said first lever for limiting movement thereof toward said electrical breaking position; a pin mounted on said module for movement in the path of movement of said second lever to be engaged thereby as said contacts move toward said electrical breaking position; a spring biasing said pin toward said second lever; and means for adjusting the bias applied by said spring.

16. In a pressure switch including a frame, a diaphragm secured to said frame and having one side adapted to be exposed to fluid under pressure and an opposite side, a spring acting against said opposite side in opposition to said fluid under pressure, a fixed contact mounted on said frame, a movable contact, a first lever pivoted on said frame and mounting said movable contact for movement between electrically making and breaking positions with respect to said fixed contact, a second lever pivoted to said frame and linked to said diaphragm for movement therewith, and an over center mechanism interconnecting said first and second levers, the improvement comprising an adjustable stop on said frame for selectively limiting the movement of said movable contact toward said electrical breaking position;

said switch including a contact module on said frame and said stop being adjustably mounted on said module for selective positioning in a plurality of positions in the path of movement of said first lever;

said contact module including a generally U-shaped bracket having a bight with straight, unbent, spaced legs terminating in oppositely directed feet and formed by bending a piece of metal and an insulating arc box secured to said bracket, said levers being pivoted between the legs of said bracket and said arc box carrying said fixed contacts and being mounted over the bight, said legs having shoulders adjacent said bight and adjacent said feet on the straight unbent parts thereof; the spacing between the shoulders on one leg being identical to the spacing between corresponding shoulders on the other leg, the shoulders adjacent said bight engaging said arc box and the shoulders adjacent said feet engaging said frame, whereby said legs are relatively precisely aligned with one another in spite of irregularities in the bending of the metal piece.

17. In a pressure switch having a frame; a diaphragm mounted on the frame and having one side adapted to be subjected to pressurized fluid; a bracket mounted on said frame oppositely of said diaphragm and mounting a spring in opposition to said diaphragm, at least one contact moving lever coupled to said diaphragm, and a fixed electrical contact; the improvement wherein said bracket is U-shaped having a bight connected by bends to straight, unbent legs, said legs terminating in feet connected thereto by bends and mounted to said frame; said legs, at both ends thereof and at locations before the bends connecting the legs to said bight and said feet, having stamped shoulders with the spacing between the shoulders on one leg equalling the spacing between the shoulders on the other leg, said fixed electrical contact being positioned by the shoulders of both legs adjacent said bight, said lever being journalled in journal openings stamped in said legs and being positioned by the shoulders of both legs adjacent said feet engaging said frame.

18. The pressure switch of claim 17 wherein there are first and second levers interconnected by an over center mechanism, both of said levers being journalled in stamped journal openings in said legs, said first lever being coupled to said diaphragm and said second lever carrying a movable contact for movement toward and away from said fixed contact.

19. The pressure switch of claim 18 wherein said frame includes aligning openings and said legs have unbent projections adjacent said feet and extending into said aligning openings past the shoulders adjacent said feet to properly space said legs.

* * * * *